United States Patent [19]

Seal

[11] Patent Number: 4,795,147

[45] Date of Patent: Jan. 3, 1989

[54] CONVERTIBLE EXERCISE DEVICE

[75] Inventor: John Seal, Auburn, Ala.

[73] Assignee: Diversified Products Corporation, Opelika, Ala.

[21] Appl. No.: 161,409

[22] Filed: Feb. 23, 1988

Related U.S. Application Data

[63] Continuation of Ser. No. 819,013, Jan. 15, 1986, abandoned.

[51] Int. Cl.[4] ..... A63B 69/06

[52] U.S. Cl. ..... 272/72; 272/DIG. 4; 272/130; 272/134

[58] Field of Search ..... 272/72, 116, 130, 134, 272/DIG. 4, 144, 132, 135, 145

[56] References Cited

U.S. PATENT DOCUMENTS

| | | | |
|---|---|---|---|
| 3,586,322 | 6/1971 | Kverneland | 272/72 |
| 3,770,267 | 11/1973 | McCarthy | 272/58 |
| 4,183,520 | 1/1989 | Chase | 272/130 |
| 4,421,307 | 12/1983 | Cunnington et al. | 272/72 |
| 4,477,071 | 10/1984 | Brown et al. | 272/72 |
| 4,488,719 | 2/1984 | Brown et al. | 272/72 |
| 4,602,780 | 7/1986 | Gall | 272/134 X |
| 4,621,623 | 11/1986 | Wang | 272/72 |
| 4,627,610 | 12/1986 | Ishida et al. | 272/72 |
| 4,723,774 | 2/1988 | Monforte | 272/72 |

OTHER PUBLICATIONS

DP Shape Master 1000 Assembly Instructions, 1984, Diversified Products Corp.

*Primary Examiner*—Richard J. Apley
*Assistant Examiner*—Howard Flaxman
*Attorney, Agent, or Firm*—Banner, Birch, McKie & Beckett

[57] ABSTRACT

A multi-function exercise device capable of assuming a variety of exercise orientations and configurations. A bi-directional attaching assembly allows the frame assembly of the exercise device to be configured to be either substantially coplanar or substantially non-coplanar to a longitudinal seat rail. Additionally, a ground-engaging support assembly allows the exercise device to be oriented in either a horizontal, inclined, or vertical orientation.

14 Claims, 6 Drawing Sheets

CONVERTIBLE EXERCISE DEVICE

This application is a continuation of application Ser. No. 819,013, filed Jan. 15, 1986, now abandoned.

BACKGROUND OF THE INVENTION

This invention relates to physical exercising apparatus. More particularly, this invention relates to an exercising apparatus which may be oriented and configurated to perform a wide range of exercises.

Exercise—heart pounding, muscle popping, sweat dripping exercise. We all know that it is good for us and leads to good health. However, most people find it difficult to find the time or inclination to exercise regularly.

Many pieces of exercise equipment are of course available to facilitate exercising in the convenience of one's home. However, most equipment which has been available for home use has not provided a full range of exercise options. Accordingly, the person wishing to exercise at home has been forced to purchase either several pieces of different equipment for exercising all muscle groups and for performing both aerobic and anaerobic exercises, or to forego exercising certain muscle groups or prforming certain exercises. In commonly assigned U.S. Pat. No. 4,477,071 a convertible rowing exercise device is disclosed which is capabale of use in any of a plurality of orientations and is adapted to be selectively used as a rowing machine or for performing other types of exercises. While the device disclosed in the U.S. Pat. No. 4,477,071 provides a single compact exercising device capable of performing many different exercises, it is desirable to expand even further the variety of exercises which can be performed on a rowing-type home exercise device.

SUMMARY OF THE INVENTION

It is, therefore, an object of the invention to provide a simple and compact exercising apparatus which is adaptable so that a wide range of different exercises, including rowing exercises, may be performed.

This and other objects of the invention are accomplished by providing a multi-functional physical exercising apparatus capable of use in any of a plurality of orientations and exercise configurations. The apparatus includes a longitudinally extending rail member. A seat slidable on the rail member may be slidably attached to the rail member for performing certain exercises, such as rowing exercises. The front end of the rail member is supported by a frame assembly. The back end of the rail member is supported by a ground-engaging support assembly. The frame assembly comprises spaced parallel lever support members and a front support assembly fixed between the lever support members. A pivoted movable lever, including a user-engageable handle, is operatively connected to each of the lever support members of the frame assembly. A foot member may be attached to one end of each of the lever support members. The foot member is selectively engageable to provide auxiliary support to the exercise apparatus when it is in its inclined orientation. Bi-directional attaching means is fixed to the frame assembly for selectively attaching the frame assembly to the rail member in either a co-planar configuration, so that the rail member and lever support members are substantially co-planar, or in a non-coplanar configuration, so that the rail member and the lever support members are substantially perpendicular. Preferably the bi-directional attaching means comprises a first tubular sleeve and a second tubular sleeve substantially perpendicular to the first tubular sleeve. Either of these tubular sleeves may be selectively positioned on one end of the rail member to provide the desired coplanar or non-coplanar configuration of the exercise apparatus.

The exercise apparatus of the present invention preferably includes adjustment means for adjusting the position of the frame assembly on the rail member when the frame assembly and the rail member are substantially coplanar.

Resistance means, such as hydraulic dampers conventionally used in exercise equipment, are operatively connected to each of the levers and to each of the lever support members for providing resistance to the movement of the lever.

The present invention also includes support means for selectively supporting the back end of the rail member in one of three orientations: a substantially horizontal orientation; an inclined orientation; or a substantially vertical orientation. The support means comprises a ground-engaging support member which comprises spaced parallel legs and a cross-beam member asymmetrically fixed between the legs. The ground-engaging support member further comprises coupling means fixed to the cross-beam member for selectively coupling the ground-engaging support member to rail member. The cross-beam member is asymmetrically fixed between the spaced parallel legs so that the legs have a short end to one side of the cross-beam member and a long end to the other side of the cross-beam member. Preferably, a combination support-handgrip is fixed to one end of each of the legs and is substantially perpendicular to the legs. The combination support-handgrip is adapted to engage the floor and support the exercise apparatus in one of its orientations and is adapted to be user-engageable in another of the orientations of the exercise device thereby increasing the range of exercises which can be performed with the apparatus.

An auxiliary user-support may be selectively fixed between the pivoted movable levers or positioned over the rail member to thereby further increase the range of exercises which can be performed with the apparatus.

DETAILED DESCRIPTION

Figure 1:
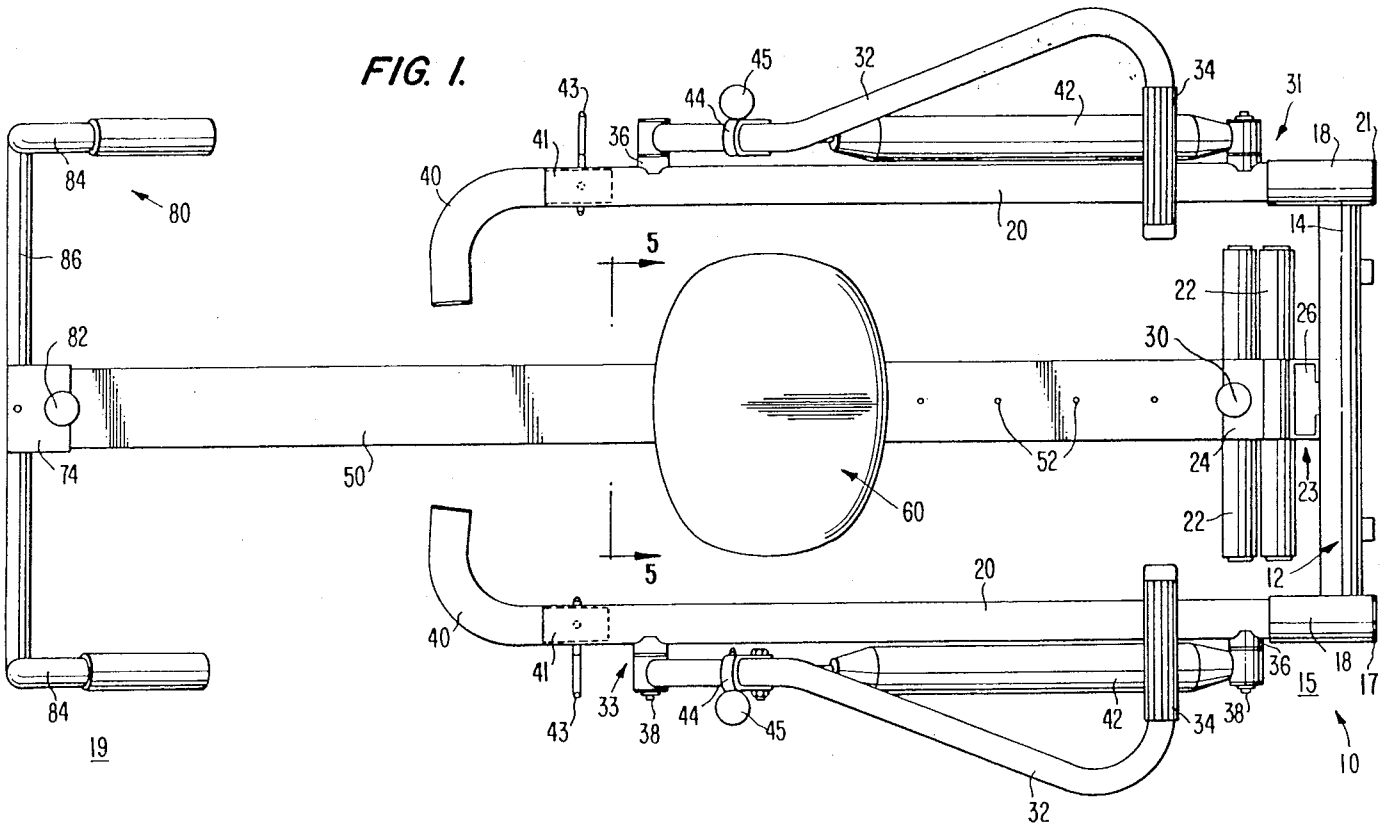
FIG. 1 is a top plan view of exercising apparatus according to the present invention.

The present invention is a multi-functional exercise apparatus which may be oriented and configured to perform a wide range of exercises. In particular, the present invention is adaptable to perform rowing exercises in either a standard, horizontal orientation or in an inclined orientation. The present invention may also be used to do benchpresses, abdominal and lower back exercises, curls, squats and myriad other exercises essential to a well-rounded exercise program. As shown in the drawings, the particular construction of a preferred embodiment of the invention includes a frame assembly generally designated at 10. Frame assembly 10 includes a front support assembly 12, which supports the front, designated generally at 15, of the exercise apparatus. Front support assembly 12 preferably comprises a base member 14 and depending support members 16. Preferably members 14, 16 are hollow tubular members, although other structural support members may, of course, be used. Tubular attachment members 18 are fixed to each of support members 16. As shown clearly in FIG. 2, tubular attachment members 18 are substantially perpendicular to support members 16. Tubular members 18 have an open end facing the back, designated generally at 19, of the exercise apparatus. The other end of members 18 is preferably closed by a plug 17.

Spaced lever support members 20 are fixed within the open end of each of tubes 18 and project towards back 19 of the exercise apparatus. Preferably, lever support members 20 are tubular structural members which fit within tubes 18 and are secured in place by a conventional coupling element, shown generally at 21. Lever support members 20 may, of course, be fixed to front support assembly 12 in other ways for joining tubular support members or the like. Feet 23 may be positioned on the bottom side of lever tube 20 and tubular attachment members 18 to support the assembly on the floor or other support surface.

Foot tubes 22 are fixed to front support assembly 12 to allow the user to brace the user's feet while performing certain exercises. An attaching member is fixed to frame member 12. The attaching member allows the entire frame assembly 10, comprising front support assembly 12, lever support members 20, and the levers and resistant cylinders fixed to lever support members 20, to be reconfigured easily and quickly with respect to the remaining elements of the apparatus. The attaching member preferably comprises a first tube 24, referred to as a coplanar attaching tube, and a second tube 26, referred to as a non-coplanar attaching tube. These reference designations will be further explained below.

Figure 2:
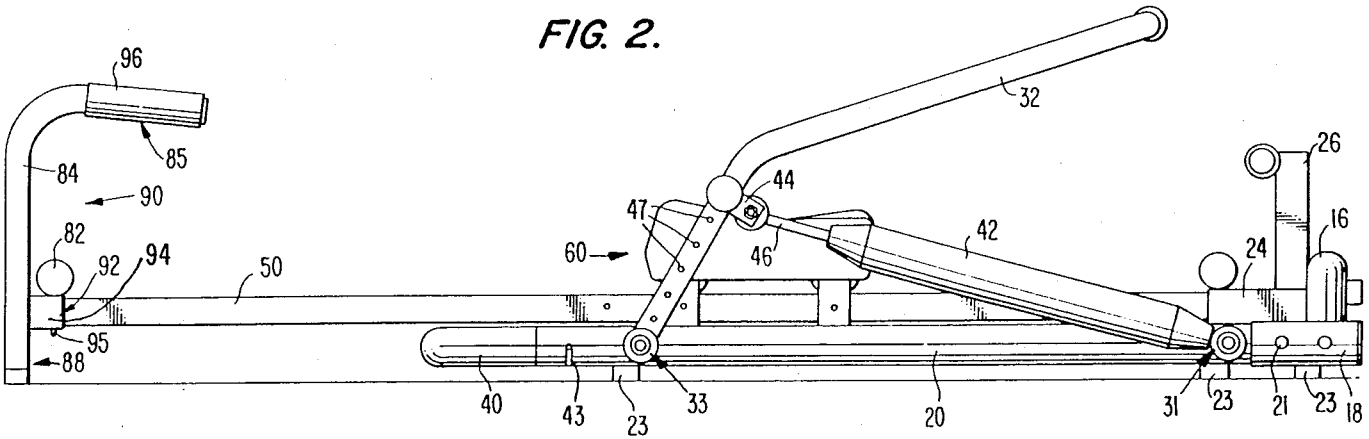
FIG. 2 is a side plan view of the exercising apparatus shown in FIG. 1.
Figure 3:
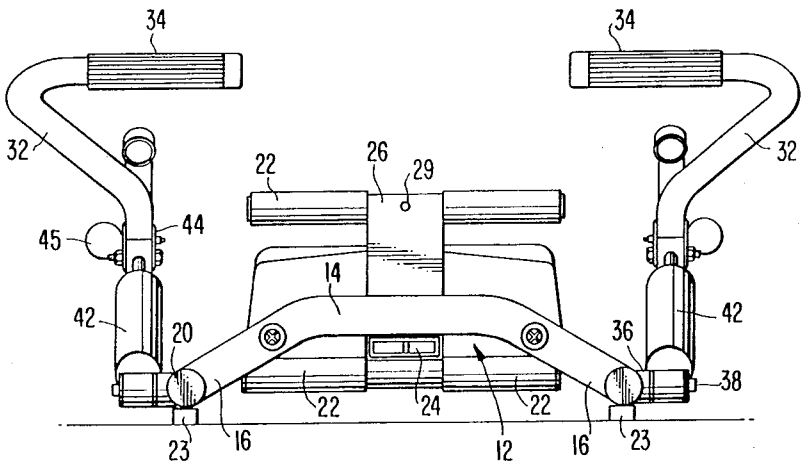
FIG. 3 is a front plan view of the exercising apparatus shown in FIG. 1.

Tube 26 may be positioned substantially perpendicular to and on top of tube 24 so that the top outer wall of tube 24 forms a bottom wall of tube 26, as shown in FIG. 2. Preferably, tube 24 is open on both its ends to allow the seat rail to be inserted from either end, further expanding the exercises which can be performed on the present invention.

Each of lever tubes 20 includes a front pivot rod, shown generally at 31, and a rear pivot rod, shown generally at 33. A pair of levers 32 formed at their free or distal ends with handles 34 are pivotally mounted to rear pivot rods 33 on lever tube 20. A spacer 36 is preferably placed over pivot rod 30 to space lever 32 from lever tube 20. A push nut 38 preferably is provided to secure levers 32 to rear pivot rod 33. Preferably the levers 32 are attached to the rear pivot rods of lever tubes 20 so that the handgrips 34 are facing each other, as shown in FIG. 1. Other methods of pivotally connecting levers 32 to lever tubes 20 may of course be used.

An inclined support foot 40 may be fixed to the open back end of lever tube 20. Preferably, foot 40 is a tubular member of a generally L-shaped configuration. Support foot 40 includes one end 41 of reduced diameter which can be inserted into the open back end of lever tube 20. A pull pin 43 passing through aligned apertures in lever tube 20 and end 41 of foot 40 serves to securely couple support foot 40 to lever tube 20.

Pneumatic resistance cylinders 42 are fixed to the front pivot rods 31 on lever tube 20 in a similar manner as are levers 32 fixed to lever tube 20. Thus, cylinders 42 are fixed over front pivot rod 31 and are spaced from lever tube 20 by a spacer 36. A push nut 38 may be provided to secure cylinder 42 to front pivot rod 31.

A clevis assembly 44 is fixed to the end of cylinder rod 46 of cylinder 42. Clevis assembly 44 also is fixed to lever 32 by a pull pin 45 passing through aligned apertures in clevis 44 and lever 32. Lever 32 may be provided with several spaced adjustment holes 47 through which pull pin 45 may pass. Connecting clevis 44 and thus cylinder 42 to different ones of adjustment holes 47 will provide a different level of exercise resistance, which may be set according to the exercise resistance desired by a particular user for a particular exercise.

Figure 4:
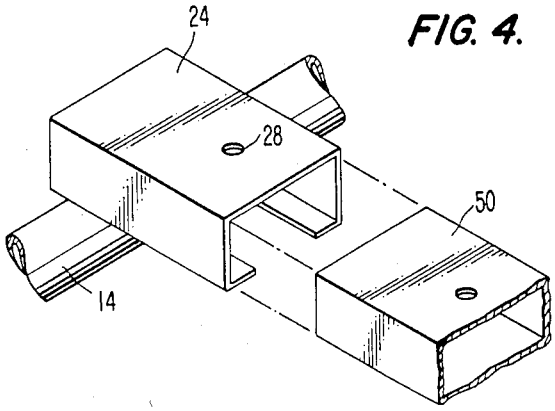
FIG. 4 is a sectional view of a representative coupling method used in the present invention.

A seat rail 50, having preferably a rectangular cross-section, is inserted within one of attaching tubes 24 or 26, depending on the particular exercise configuration desired. The cross-section of seat rail 50 is selected to be complementary to that of tubes 24 and 26 so that they may interconnect and be coupled, as shown generally in FIG. 4. Attaching tubes 24 and 26 include apertures 28 and 29, respectively, for coupling seat rail 50 to one of tubes 24 or 26. As shown clearly in FIG. 1, one end of seat rail 50 has adjustment holes 52. In order to couple frame assembly 10, including front support assembly 12, lever tubes 20, levers 32, and cylinders 42, to seat rail 50, a pull pin 30 is inserted through the selected one of aperture 28 or 29 and one of adjustment holes 52. Adjustment holes 52 allow frame assembly 10 to be positioned in various locations along seat rail 50 to accommodate users of different sizes. Thus, for example, user with short legs may position the foot tubes 22 closer to the lever arms 32 to provide a more comfortable and more appropriate exercise position.

Figure 5:
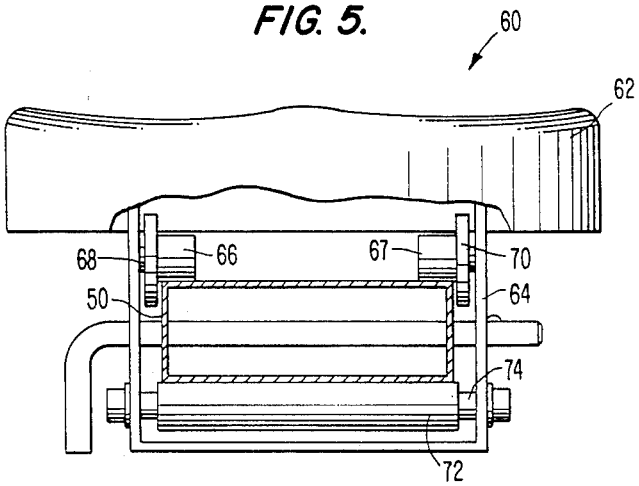
FIG. 5 is a cross-sectional view taken along line 5—5 of FIG. 1.

A slidable seat assembly 60 may be positioned on seat rail 50. Seat assembly 60 is slidable on seat rail 50 when the exercise apparatus is configured for performing certain exercises, such as rowing type exercises. As shown more clearly in FIG. 5, seat assembly 60 includes a seat 62 on which a user would sit when performing an exercise. Seat 62 is fixed to a seat bracket 64. Rollers 66 rotatable on axle 68 are fixed within bracket 64. Rollers 66 include a roller surface 67 and a flange 70. Roller surface 67 is adapted to engage the top surface of seat rail 50, as shown in FIG. 5. Flange 70 insures that roller 66 maintains its proper position. A spacer tube 72 may be rotatably fixed on a guide rod 74 within seat bracket 64. Spacer tube 72 engages the bottom surface of seat rail 50, as shown in FIG. 5. Thus, seat assembly 60 is readily slidable along the longitudinal extent of seat rail 50.

A ground-engaging support assembly 80 is fixed to the back end of seat rail 50 by a pull pin 82 passing through aligned apertures in support member 80 and in seat rail 50. As shown, ground-engaging support member 80 includes spaced parallel legs 84 and a cross-beam member 86, preferably asymmetrically fixed between legs 84 so that legs 84 have a short end 88 to one side of cross-beam member 86 and a long end 90 to the other side of cross-beam member 86. Ground-engaging support member 80 further comprises a coupling bracket 92 fixed to cross-beam member 86 for coupling support member 80 to seat rail 50. Coupling bracket 92 and seat rail 50 have complementary cross-sections and interfit in the manner shown generally in FIG. 4. Coupling member 92 comprises a preferably rectangular tube 94 in which there is an aperture 95. Pull pin 82 is inserted through aperture 95 and an aligned aperture on seat rail 50 to couple support member 80 to seat rail 50.

Preferably, legs 84 are L-shaped and include a combination support-handgrip 96 formed by a perpendicular extension 85 of long end 90 of L-shaped leg 84. The combination support-handgrip 96 is adapted to engage the floor and support the exercise apparatus when the exercise apparatus is in its inclined orientation, as will be further explained, and adapted to be engageable by the user for performing for example, push-up exercises when the exercise apparatus is in its horizontal orientation.

Figure 10:
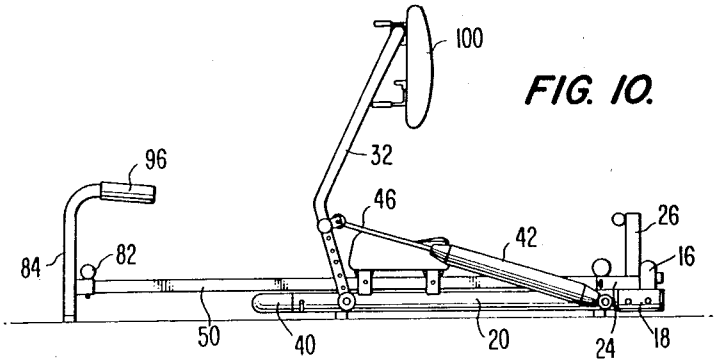
FIG. 10 is a side plan view of the exercise apparatus of the present invention shown in its horizontal orientation with an auxiliary user-support in place.
Figure 11:
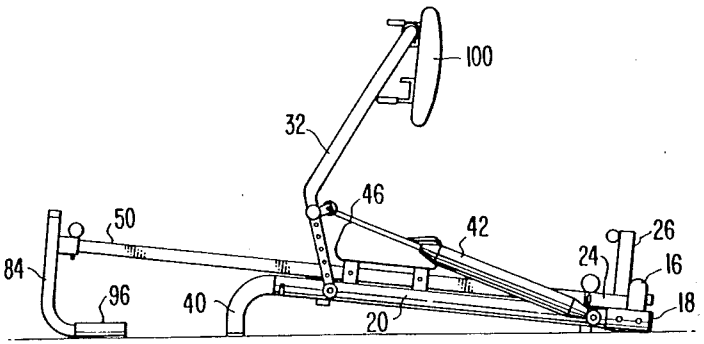
FIG. 11 is a side plan view of the present invention shown in its inclined orientation with an auxiliary user-support fixed in position.

A cushion assembly or auxiliary user support 100 may be attached to handgrips 34 of levers 32, as shown particularly in FIGS. 10 and 11. Cushion assembly 100 includes mounting brackets (not shown) which fit over the ends of handgrips 34 so that the cushion assembly can be maintained on the handgrips as shown in FIGS. 10 and 11. Alternatively, cushion 100 may be placed over seat rail 50, as shown particularly in FIG. 8, for performing certain exercises.

Having described with particularity the structure of a preferred form of the invention, its operation will now be explained.

The present invention is capable of operating in a plurality of orientations and in several exercise configurations. In particular, the exercise apparatus of the present invention may be used in either one of three orientations: a horizontal orientation, in which the seat rail is substantially horizontal with respect to the ground; an inclined orientation, in which the seat rail is inclined with respect to the ground; or in a vertical orientation, in which the seat rail is oriented vertically with respect to the ground. By selectively engaging one of attaching tubes 24 or 26 with seat rail 50, the present invention may be also used in various exercise configurations in which the frame assembly may be configured so that lever tubes 20 are substantially coplanar with seat rail 50 or alternatively configured so that lever tubes 20 are substantially perpendicular to seat rail 50. Various exercises may be performed through the combinations and permutations of the various orientations and configurations of the present invention. Additionally, the present invention may be adjustable to any desired length by adjusting the position of frame assembly 10 on seat rail 50 by using adjusting holes 52.

In the horizontal orientation, shown for example in FIGS. 2, 6, 8 and 10, incline support foot 40 of lever tube 20 is positioned so that the free ends face inwardly and each other, as shown clearly in FIG. 1. Additionally, ground-engaging support member 80 is attached to seat rail 50 so that the short ends 88 of legs 84 engage the ground, as shown clearly in FIG. 2. Thus, as shown, for example, in FIG. 2, in the horizontal mode, the exercising apparatus of the present invention is substantially horizontal or parallel to the ground and is supported on feet 23 and legs 88 of support member 80.

Figure 7:
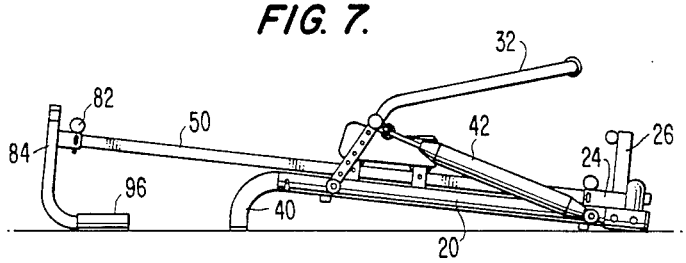
FIG. 7 is a side plan view of the exercise apparatus of the present invention shown in its inclined orientation.

To place the exercise apparatus in the inclined orientation, pull pin 43 is removed thus allowing feet 40 to be rotated 90° so that the free ends thereof engage the ground, as shown in FIGS. 7 and 11. After feet 40 are rotated to their appropriate position, pull pin 43 is reinserted so that feet 40 are securely attached to lever tube 20. Ground engaging support member 80 is removed from the end seat rail 50 by removing pull pin 82 and rotated so that support-handgrip 96 engages the ground as shown in FIGS. 7 and 11, thus elevating one end of seat rail 50 off the floor more than the other end and creating an inclined orientaion for seat rail 50 and the exercising apparatus.

Figure 9:
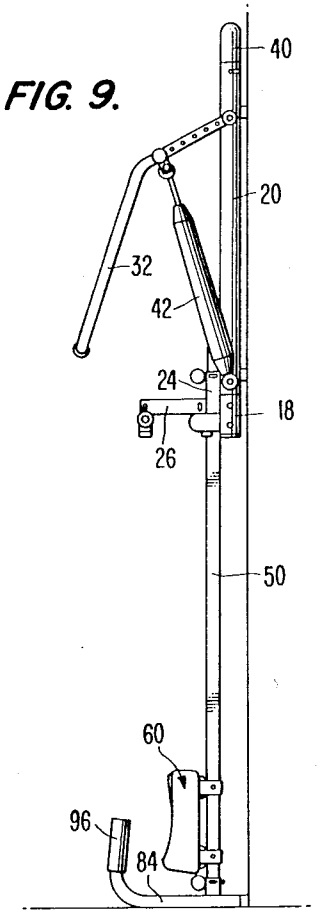
FIG. 9 is a side plan view of the exercise apparatus of the present invention shown in its vertical orientation.

In the vertical orientation, the exercise assembly is configured in the same manner as in the horizontal orientation described above. However, in the vertical orientation the exercise apparatus is positioned on one end, as shown in FIG. 9, so that ground engaging support member 80 and legs 84 rest against the ground. To provided additional support for the assembly, a wall bracket may be fixed to seat rail 50 and secured to a wall or other supporting surface to insure that the exercise apparatus is stable in the vertical position.

Figure 6:
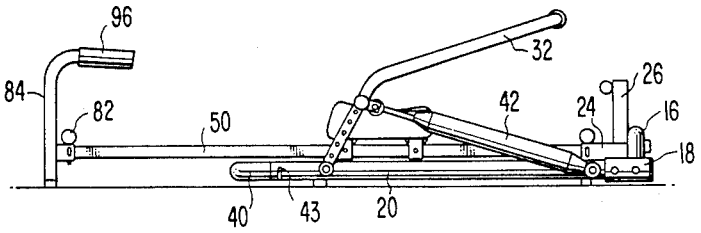
FIG. 6 is a side plan view of the exercising apparatus of the present invention shown in its horizontal orientation.

Various exercise configurations may also be made with the present invention in any of its various orientations. For example, as shown in FIGS. 6 and 7, the apparatus is configured in the coplanar configuration by coupling seat rail 50 to coplanar attaching tube 24 so that lever tubes 20 project rearwardly from frame assembly 10 and are substantially coplanar with seat rail 50. In this configuration, the user may perform, for example, rowing exercises in either the horizontal orientation, shown in FIG. 6, or the inclined orientation, shown in FIG. 7.

Figure 8:
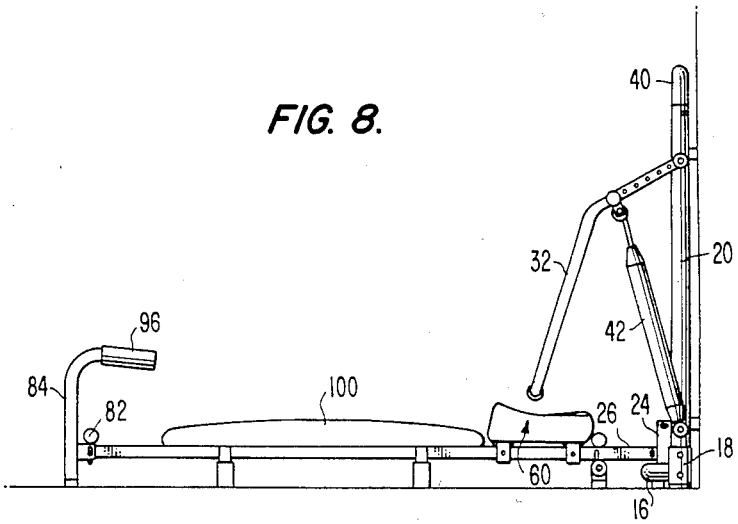
FIG. 8 is a side plan view of the exercise apparatus of the present invention shown in its horizontal orientation and in a non-coplanar exercise configuration.

In FIG. 8, the apparatus is shown configured in the non-coplanar configuration, horizontal orientation. In this configuration, the frame assembly is substantially perpendicular to seat rail 50 by coupling seat rail 50 to non-coplanar attaching tube 26.

In FIG. 9, the apparatus is shown in a vertical orientation with a coplanar configuration. However, in this coplanar configuration, unlike that shown in FIGS. 6 and 7, lever tubes 20 project forwardly from frame assembly 10. Rearward or forward projection is made possible since coplanar attaching tube 24 is open at both its ends, thus permitting the frame assembly to be coupled to seat rail 50 from either side of the frame assembly.

The present invention may be configured to do abdominal or lower back exercises by attaching cushion 100 to handgrips 34 as shown in FIGS. 10 and 11. This configuration may be selected either in the horizontal or inclined orientation.

Although a preferred embodiment has been described, the invention is not intended to be limited thereto. By selectively arranging the positions of frame assembly 10, seat rail 50 and support assembly 80, many different orientations and configurations may be obtained. Various modifications will occur to those of ordinary skill in the art and the invention is defined only by the following claims.

I claim:

1. A multi-functional physical exercising apparatus capable of use in any of a plurality of orientations and configurations comprising:

a longitudinal seat rail;

a frame assembly coupled to one end of said seat rail, said frame assembly comprising a support assembly for supporting one end of said seat rail, longitudinally extending lever support members for supporting user-engagable levers fixed to said lever support members, and resistance means for providing exercise resistance fixed between said lever support members and said levers;

coplanar attaching means fixed to said frame assembly for selectively attaching said frame assembly to said longitudinal seat rail so that said longitudinally extending lever support members and said seat rail are substantially coplanar; and non-coplanar attaching means fixed to said frame assembly for selectively attaching said frame assembly to said longitudinal seat rail so that said longitudinally extending lever support members and said seat rail are substantially non-coplanar;

wherein said frame assembly including said lever support members are reorientable and reconfigurable with respect to said longitudinal seat rail to be substantially coplanar with said longitudinal seat rail when said frame assembly is attached to said longitudinal seat rail through said coplanar attaching means and to be substantially non-coplanar with said longitudinal seat rail when said frame assembly is attached to said longitudinal seat rail through said non-coplanar attaching means.

2. An exercising apparatus as recited in claim 1 wherein said frame assembly has a front side and a rear side and wherein said coplanar attaching means comprises means for selectively attaching said seat rail to either said front side or said rear side.

3. An exercising apparatus as recited in claim 2 further comprising coplanar adjustment means for adjustably and selectively positioning said frame member at various positions along the length of said seat rail when said support rail and said frame member are substantially coplanar.

4. An exercising apparatus as recited in claim 3 further comprising ground-engaging support means selectively attached to said seat rail for selectively supporting the exercising apparatus oriented either substantially parallel to the ground or oriented inclined with respect to the ground.

5. An exercising apparatus as recited in claim 4 wherein said lever support members further comprise an inclined foot support means for selectively providing additional support to the exercising apparatus when the exercising apparatus is oriented inclined with respect to the ground.

6. An exercising apparatus as recited in claim 4 wherein said ground engaging support means further comprises user-engageable handgrips fixed to one end of said ground engaging support means so that said hangrips are raised above the ground when the exercising apparatus is oriented substantially parallel to the ground and said handgrips engage the ground to support the exercise apparatus when the exercise apparatus is oriented inclined with respect to the ground.

7. An exercise apparatus as recited in claim 2 wherein said coplanar attaching means comprises an open ended tubular member and wherein said non-coplanar attaching means comprises a tubular member fixed to and perpendicular to said open ended tubular member.

8. A multi-functional exercise apparatus comprising:

a longitudinally extending rail member;

a frame assembly fixed to one end of said rail member, said frame assembly comprising a support assembly for supporting one end of said rail member;

lever support members fixed to said support assembly;

a pivoted movable lever operatively connectd to each of said lever support members; to each of said lever support members for providing resistance to the movement of said lever; and bi-directional attaching means fixed to said frame assembly for selectively attaching said frame assembly to said rail member in either a coplanar position so that said rail member and said lever support members are substantially coplanar, or in a non-coplanar position so that said lever support members and said rail member are substantially perpendicular, said frame assembly including said lever support members being reorientable and reconfigurable to be substantially coplanar with said rail member in said coplanar position and to be substantially perpendicular to said rail member in said non-coplanar position.

9. An exercise apparatus as recited in claim 8 wherein said bi-directional attaching means comprises a first tubular sleeve and a second tubular sleeve substantially perpendicular to said first tubular sleeve.

10. An exercise apparatus as recited in claim 7 further comprising adjustment means for adjusting the position of said frame member on said rail member when said frame member and said rail member are substantially coplanar.

11. An exercise apparatus as recited in claim 9 further comprising a slidable seat selectively attachable to and slidable on said rail member.

12. An exercise apparatus as recited in claim 10 further comprising an auxiliary user support selectively attachable between said pivoted movable levers.

13. An exercise apparatus as recited in claim 8 further comprising a ground-engaging support member, said support member having spaced parallel legs and a cross-beam member asymmetrically fixed between said legs so that said legs have a short end to one side of said cross-beam member and a long end to the other side of said cross-beam member, said support member further comprising coupling means fixed to said cross-beam member and a support-handgrip fixed to one end of each of said legs, said support-handgrip substantially perpendicular to said legs, said support-handgrips adapted to engage the floor and support the exercise apparatus in an inclined orientation and adapted to be user-engageable when the exercise appartus is in a horizontal orientation.

14. A multi-functional physical exercising apparatus capable of use in any of a plurality of orientations and configurations comprising:

a longitudinal seat rail;

a frame assembly coupled to one end of said seat rail, said frame assembly comprising a support assembly for supporting one end of said seat rail, said support assembly comprising a base member substantially perpendicular to said seat rail a depending support member fixed to opposite sides of said base member, an attachment member fixed to each of said support members, and ground-engaging feet members fixed to said attachment members;

a longitudinally extending lever support member attached to each of said attachment members;

user-engagable levers fixed to said support lever members, and resistance means for providing exercise resistance fixed between said lever support members and said levers;

coplanar attaching means fixed to said base member of said frame assembly for selectively attaching said frame assembly to said longitudinal seat rail so that said longitudinally extending lever support members and said seat rail are substantially coplanar; and non-coplanar attaching means fixed to said coplanar attaching means for selectively attaching said frame assembly to said longitudinal seat rail so that said longitudinally extending lever support members and said seat rail are substantially non-coplanar;

wherein said frame assembly including said lever support members are reorientable and reconfigurable to be substantially coplanar with said longitudinal seat rail when said frame assembly is attached to said longitudinal seat rail through said coplanar attaching means and to be substantially non-coplanar with said longitudinal seat rail when said frame assembly is attached to said longitudinal seat rail through said non-coplanar attaching means.

* * * * *